US005333357A

United States Patent [19]

Duncan

[11] Patent Number: 5,333,357

[45] Date of Patent: Aug. 2, 1994

[54] CARDING MACHINE HAVING A FINE-FIBER BRUSH

[76] Inventor: Richard N. Duncan, 21740 SE. Edward Dr., Clackamas, Oreg. 97015

[21] Appl. No.: 72,510

[22] Filed: Jun. 4, 1993

[51] Int. Cl.[5] ..... D01G 15/76

[52] U.S. Cl. ..... 19/99; 19/108; 19/107

[58] Field of Search ..... 19/107, 98, 100, 102, 19/104, 99, 110, 113, 12, 219, 108

[56] References Cited

U.S. PATENT DOCUMENTS

| | | | |
|---|---|---|---|
| 127,566 | 6/1872 | Chase et al. | 19/100 |
| 185,332 | 12/1876 | Klein | 19/99 |
| 240,631 | 4/1881 | Abbott | 19/108 |
| 745,974 | 12/1903 | Sullivan . | |
| 2,115,605 | 4/1938 | Allen et al. | 19/99 |
| 2,420,035 | 5/1947 | Fairbairn | 19/99 X |
| 3,225,391 | 12/1965 | Whitehurst | 19/98 |
| 3,402,432 | 9/1968 | Kalwaites | 19/104 |
| 4,161,805 | 7/1979 | Worley | 19/98 |
| 4,817,246 | 4/1989 | Bacchio | 19/98 |

FOREIGN PATENT DOCUMENTS

| | | | |
|---|---|---|---|
| 109449 | 4/1925 | Switzerland | 19/107 |

OTHER PUBLICATIONS

B. D. Corbman, *Textiles: Fiber to Fabric,* fifth edition 1975, pp. 40, 42 & 43. McGraw-Hill, New York.

W. Von Bergen et al, *American Wool Handbook,* second edition 1948, Textile Book Publishers, Inc., NY, pp. 457–461.

*Primary Examiner*—Clifford D. Crowder
*Assistant Examiner*—John J. Calvert
*Attorney, Agent, or Firm*—Edward B. Watters

[57] ABSTRACT

An improved carding process utilizing a brush attached to a cylinder carding machine for inhibiting the buildup of napped fibers. Mounted just downstream of the transfer region where carding takes place, the brush is stationary with respect to the revolving cylinders. The brush is disposed across the face of the carding drum with the nylon bristles of the brush engaged in the card-cloth wires of the drum. The bristles continuously brush, straighten and force napped fibers down into the wires of the carding cylinder, which results in a thicker, heavier web of carded fibers and virtually eliminates buildup of fluffy fibers on the carding drum as well as the input drum.

23 Claims, 5 Drawing Sheets

CARDING MACHINE HAVING A FINE-FIBER BRUSH

BACKGROUND OF THE INVENTION

This invention relates to the manufacture of textiles, and more particularly to the carding of fibers, including an improved method of carding wool and fine-fiber hairs, and apparatus for carrying out the method.

In the manufacture of textiles, an implement or machine called a card or carder is utilized to process fiber stock such as grease wool or picked fleece, to disentangle, arrange and collect together the individual fibers in an arrangement suitable for spinning. The carding process, historically a handicraft, was mechanized in the mid to late eighteenth century.

A card employs "card cloth" or wire "clothing" which comprises a matrix of wire tines or teeth, set closely spaced apart in rows, in a suitable foundation such as leather, rubber or synthetic material. The wire tines are usually bent to a uniform angle, all pitched in the same general direction, the points providing in concert a surface for the action of carding fiber stock such as wool. In the carding process, two opposed wired surfaces are moved relatively in opposite directions, the wired surfaces of the adjacent cards being close to each other, but not touching or meshing. The surfaces are disposed such that the points of the wire clothing of the respective surfaces pitch in opposite directions, working point against point, and this opposition provides, in part, the tension applied to fibers disposed between the card surfaces.

Carding subjects fiber stock, a tight mass of tangled, matted fibers having nonuniform and erratic distribution throughout the mass, to forces set up between two card-cloth surfaces. Fiber stock is applied to a first one of the surfaces, where it is held, entangled among the wires. Carding takes place when there is forcible transfer of individual fibers from the first card-cloth surface to the other surface. Fibers of the stock are held by friction on the card-cloth wires of the first card. Wires of the empty card, passing near the wires of the card charged with fibers, snag and hold individual fibers of the mass, causing tension in the fibers, and it is the tension built up in the fibers in overcoming the frictional forces holding the fibers which effectuates carding. When the tension is sufficient to overcome the frictional force holding a fiber to the wire(s) of the first surface, the fiber is released, forcibly extracted and transferred to the surface of the second card with a whipping action induced by spring temper of the wires. The transferred fibers are thus collected and laid down in a coalescent web or sheet of intermeshed fibers termed a bart or sliver. The purpose of carding is to achieve a uniform distribution of density of fibers in a bart ,necessary to allow maximum control by the hand spinner in drafting, or by machines in drawing and spinning yarn. Depending on the type of fiber carded and the kind of yarn desired, one carding may suffice, while other fibers and blends of fibers may require additional cardings to achieve the degree of evenness and uniformity of distribution of the fibers desired for spinning. The carding process can be repeated by stripping the bart of partially carded fibers from the second surface, reapplying the batt to the first surface and carding the fibers again to further open, straighten and redistribute the fibers. Whether performed manually as a handicraft, or effected on a large scale by industrial machinery, the carding process is essentially the same.

Artisans who spin yarn by hand often prepare fiber stock for spinning by utilizing hand-held cards, which look like flat, rectangular paddles with handles; the paddles have card cloth affixed to one side. Other artisans and hand spinners prepare fibers for spinning on small, two-cylinder carding machines, called "drum carders," which have card-cloth wires disposed on the surfaces of two cylinders or drums of different size, rotating with their surfaces tangentially adjacent and parallel to each other. Large industrial carding machines employ multiple stages of carders, each stage having small worker and stripper drums set successively closer to a large main cylinder or swift, thus subjecting the fiber stock to repeated carding, and a thorough opening, cleaning and straightening of the fiber. The carded fibers are removed from the main cylinder by a dolling cylinder, as described below.

Small, drum carders utilized by artisans employ two rotating cylinders journaled on a wooden frame: a small diameter input drum or "licker-in," and a larger diameter carding drum or swift, the swift rotating considerably faster than the licker-in. Although some of these machines are powered by small electric motors, the process is essentially a handicraft, the machines being fed and stripped by hand, and commonly operated manually by a hand crank. Fiber stock loaded onto a feed pan adjacent the licker-in is impaled by the wire teeth of the smaller cylinder, pulled in and held on the surface of the cylinder as it rotates. The carding takes place along a narrow gap between the surfaces of the licker-in and the swift, called the transfer region, where the surfaces approach closely but do not touch or intermesh. Some of the fibers projecting above the teeth of the licker-in are readily caught by the wire clothing on the surface of the swift, which is moving rapidly in the opposite direction relative to the licker-in, the wires working point against point, pulling the fibers away against resistance from the smaller cylinder, thus disentangling, straightening and opening the mat of fibers, the extracted fibers cohering in the wires of the swift. After a web or batt of carded fiber of sufficient thickness is collected on the swift, the machine is stopped and the web manually stripped or doffed, and further processed by additional carding, or by spinning.

The carding process is inherently complex for the artisan because of the wide range of properties of fibers and various blends of fibers, and handicraft carding can be extremely demanding of the time and patience of the practitioner, often requiring that the fibers be passed through the drum carder several times, using different settings of drum separation, various densities of card-cloth wires, and/or different relative speeds of the drum surfaces. The spacing and parallelism of the cylinders, the pitch and density of the teeth, the relative speed of the drum surfaces, the manner and rate at which the fiber stock is input into the feed tray, and the properties (and mixes) of the fibers, are all critical factors which affect the efficacy of the carding process. Considerable experience and skill are required of the artisan to successfully card fiber with a drum carder.

The carding of fine-fiber hair such as alpaca, angora rabbit, cashmere, mohair, etc., is more difficult than processing ordinary coarse wool, because such fine fibers generally are shorter and smoother, having fewer convolutions and epidermal scales than most wool, and therefore less disposed to be held by friction on the card-cloth wires and grasped by the moving card-cloth wires of the opposed surface. Consequently, when the shorter, smoother fibers are caught by the moving wire clothing of the carding drum, many of the fibers are pulled up but not extracted from the fiber stock disposed on the input drum, while other fibers are easily released from the wire clothing of the input drum; therefore, little tension is developed in the fibers, resulting in ineffectual carding. Fibers are left protruding above the surface of both the carding and input drums, where they interfere with the carding process and build up rapidly above the wire tines to form a villous or fluffy nap. The buildup of napped fibers is believed to be caused, also, in part, by static electricity, wherein static charges induced in the smoother fibers by the motion of the drums causes the loosened fibers to extend outward from the surface of the drum. The napped fibers clog the carder, resulting in an excessively fluffy bart of partially and incompletely carded fibers. The problem of excessive fluffing is seen also in the carding of shorter, fine-fiber wools such as those produced, for example, by merino and rambouillet breeds of sheep, The problem is conventionally solved by one or more of the following: providing a more dense card clothing for processing the smooth, short fibers; adjusting the gap between the drums of the carder; or additional passes of the fluffy batts through the carding machine. However, these conventional solutions are expensive, labor intensive, time consuming, and not always effective.

Brushes are known in certain industrial carding machines; however, such brushes are not employed intrinsically in the carding process, but perform some other function apart from carding, as to extract material from rotating cylinders, or to clean waste material from particular elements of the machine. For example, in the latter instance, a rotating drum having bristles disposed in a spiral configuration cleans residual lint from the flats of cotton carders. In the former instance, a "fancy roller," utilizing long, brush-like wire clothing, working back against back in relation to the card-cloth wires of the swift, brushes up or lifts a web of carded fibers above the surface of the swift, so that the web is in a position favorable for transfer to a dolling cylinder, the element which removes the carded web from the swift.

It is therefore a principle object of my invention to provide an improved carding machine.

Another object of the invention is to provide an improved process for carding wool and fine fibers, and to provide apparatus for carrying out the process.

It is another object of my invention to provide an improved drum carder for artisans who prepare fiber for spinning.

Another object of the invention is to provide apparatus in a carding machine which inhibits the buildup of fluffy nap in a web of carded fibers.

Another object of the invention is to provide apparatus in a cylinder carding machine which prevents clogging of the transfer region of the carding mechanism with napped fibers.

Another object of the invention is to provide apparatus in a carding machine which inhibits the buildup of napped fibers on the input cylinder of the machine.

Yet another object of the invention is to provide apparatus in a cylinder carding machine which facilitates carding a wide range of stock fibers and fiber blends of different staple length, smoothness and cohesiveness, without changing the configuration of the carding machine cylinders and the card-cloth wires.

Still another object of my invention is to provide an improved cylinder carding machine having means for forcing napped fibers on the carding cylinder into the card-cloth wires of the carding machine.

Another object of the invention is to provide an improved cylinder carding machine having a brush with bristles engageable with the card clothing of the carding cylinder to brush napped fibers into the card-cloth wires positioned on an outer portion of the cylinder.

SUMMARY OF THE INVENTION

These and other objects are achieved according to the instant invention in a cylinder carding machine of the type having a cylinder means for carrying forward fiber stock input to the carding machine, and a second cylinder means for carding the fiber stock carried forward by the first cylinder means, by providing a means for inhibiting the accumulation of napped fibers on the carding means.

The nap inhibiting device is constituted by a stationary brush member mounted on the carding machine, the brush member having bristles engaged in the moving card-cloth wire of the carding cylinder. The brush member preferably includes a retractable brush that can be moved to a position in noninterfering relation with the carding cylinder when not in use.

During the carding operation, the bristles of the brush, enmeshed with the moving card-cloth wires of the carding cylinder, continuously brush, straighten and force napped fibers down into the wires of the carding cylinder, which results in a thicker, heavier bart of carded fibers and virtually eliminates buildup of fluffy fibers on the carding cylinder as well as the input cylinder.

In another aspect of the invention, I provide an improved process of carding fiber on a cylinder carding machine of the type having a carrying-forward drum and a carding drum tangentially adjacent to each other, each having card-cloth wires pitched point against point with respect to the wires of the other drum, and a brush member mounted on the carding machine, the process including rotating the drums so that the respective card-cloth wires pass in opposite sense of direction, charging the card-cloth wires of the carrying-forward drum with fiber stock, and as the drums rotate and fibers transfer from the carrying-forward drum to the carding drum thus forming a web of carded fibers, brushing napped fibers on the carding drum down into the card-cloth wires of the carding drum, and stripping the web of carded fibers from the carding drum.

In accordance with another aspect of the present invention in a carding machine having a cylinder for carrying forward fiber stock input to the machine and a second cylinder for carding the fiber stock carried forward by the first cylinder, I provide an attachment mounted on the carding machine, the attachment having a brush member engageable with the carding cylinder, the brush member inhibiting a buildup of napped fibers by brushing the napped fibers down on the carding cylinder. The brush member preferably engages the carding cylinder just downstream of the transfer region where carding is effected.

The brush is inexpensive and easy to install on a cylinder carding machine, and provides a cost effective and time saving means of broadening the range of fiber stock that can be satisfactorily processed on the machine.

The brush is conveniently mounted on the frame on which the cylinders of the carding machine are journaled, and preferably is retractably mounted and weighted to hold the bristles of the brush engaged in the rotating card-cloth wire of the carding drum. The retractable brush can be hinged out of the way to allow dolling a web of carded fiber from the carding drum.

Prior to my invention, an artisan could satisfactorily process the range of fibers from fine angora rabbit to coarse sheep fleece with a drum carder, only by purchasing multiple machines, or by providing a plurality of interchangeable drums and gearing ratios for a single machine.

BRIEF DESCRIPTION OF THE DRAWING

While the invention is set forth with particularity in the appended claims, other objects, features, the organization and method of operation of the invention will become more apparent, and the invention will best be understood by referring to the following detailed description in conjunction with the accompanying drawing, in which:

DESCRIPTION OF THE PREFERRED EMBODIMENT

Figure 1:
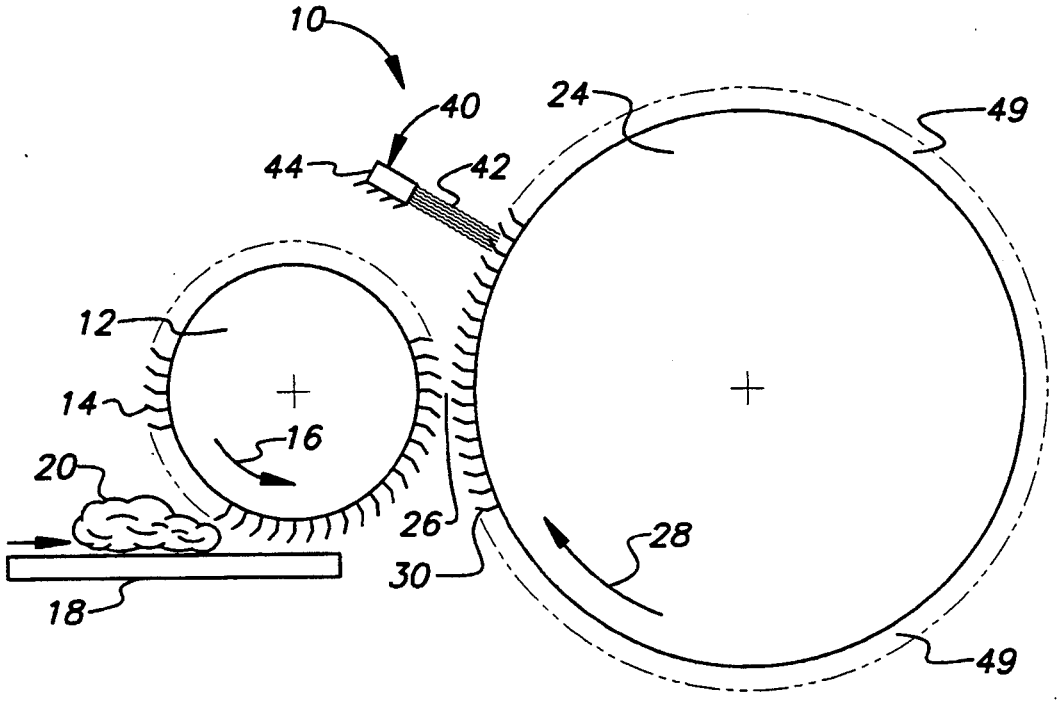
FIG. 1 is a simplified schematic diagram of a carding machine illustrating the general principals of the apparatus and method according to the instant invention.
Figure 4:
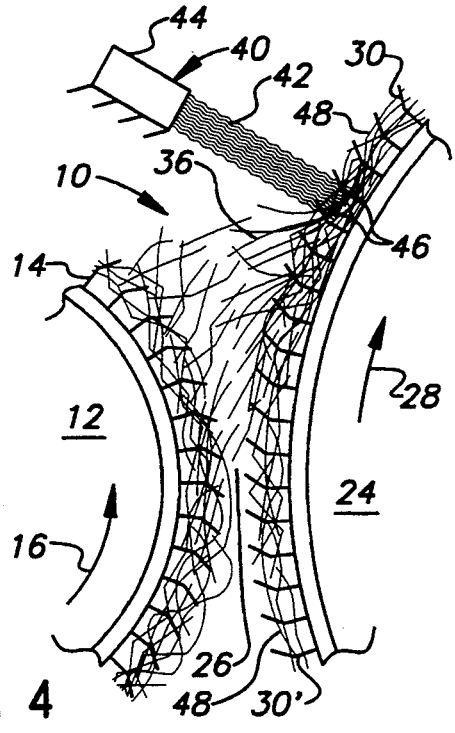
FIG. 4 is an enlarged view of a portion of FIG. 1.
Figure 5:
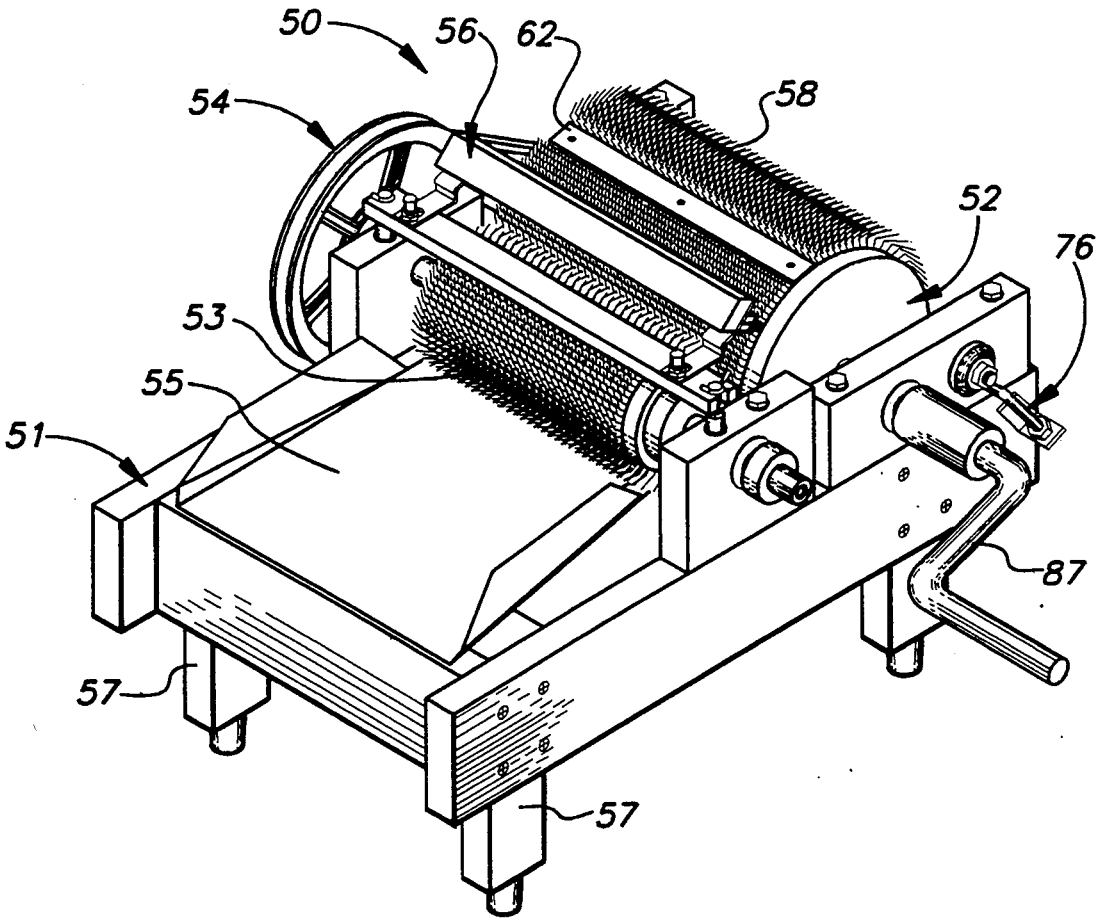
FIG. 5 illustrates pictorially a drum carder implementation of the cylinder carding machine shown schematically in FIGS. 1 and 4.
Figure 6:
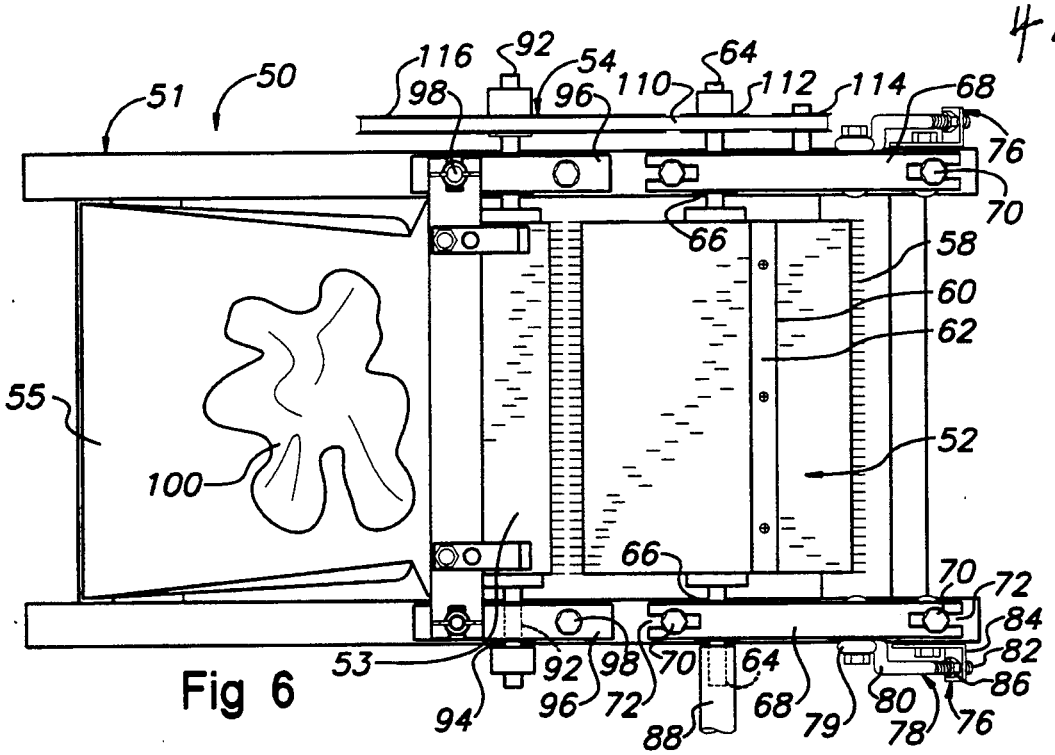
FIG. 6 is a top plan view of the drum carder of FIG. 5.

Referring now to the various views of the drawing for a more detailed description of the components, materials, construction, function, operation and other features of the instant invention by characters of reference, and in which like characters denote like elements throughout the several views, FIGS. 1 and 4 illustrate schematically a cylinder carding machine 10 having an input cylinder 12 with card-cloth wire 14 covering its curved peripheral surface. The wire clothing 14 is pitched in a direction opposite the direction of rotation of the cylinder 12, which direction is indicated by arrow 16. A feed device 18 receives fiber stock 20 such as wool for supply to the input cylinder 12, which carries the fiber stock forward in the direction 16. The fiber stock 20 presented to the machine 10 for carding can be constituted by a broad range of fiber arrangements, from unprocessed locks of virgin wool or fleece, intermediately to partially processed, picked wool, or to a lap or sliver of partially carded fibers.

Figure 2:
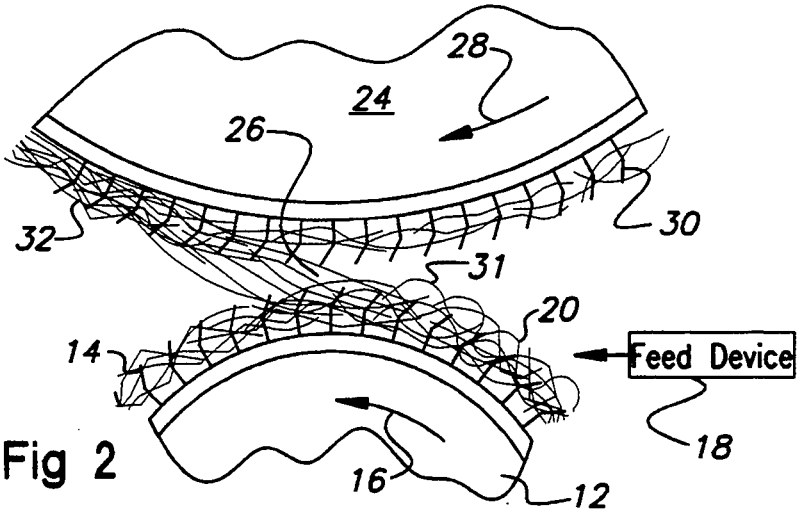
FIG. 2 schematically illustrates carding action at a transfer region between the cylinders of a carding machine.

A carding cylinder 24 rotates tangentially to the input cylinder 12 at a transfer region 26, in a direction indicated by arrow 28. The carding cylinder 24 is provided with wire clothing 30 on its curved peripheral surface, points of the wire clothing 30 being pitched in the direction of rotation 28 and opposite the direction of pitch of the card-cloth wires 14 of the input cylinder 12. The surfaces of the wire clothing, i.e., the loci of the points of the card-cloth wires 14, 30, at the transfer region 26, approach closely but do not touch or intermesh, the transfer region 26 thereby being defined by a narrow gap parallel with the axes of the cylinders and extending across the faces thereof at the conjunction of the wire clothing surfaces. One of the cylinders 12, 24 commonly rotates considerably faster than the other. In the presently described exemplary carding machine 10, the carding cylinder 24 rotates faster than the input cylinder, and although the direction of movement of the two card-cloth surfaces is the same at the transfer region 26, the sense of direction of movement of the two surfaces is opposite. Carding takes place, as illustrated schematically in FIG. 2, when the card-cloth wires 14 of the input cylinder 12 carry forward the fiber stock 20 from the feed device 18 to the transfer region 26, where some of the fibers 31 projecting above the wires 14 of the input cylinder are readily caught by the wire clothing 30 of the carding cylinder 24, which is moving rapidly in the opposite direction relative to the card-cloth wires of the input cylinder 12, the wires working point against point, the fibers being pulled away against resistance from the smaller input cylinder 12, thus disentangling, straightening and opening the mat of fibers, the extracted fibers then cohering on the wired surface 30 of the carding cylinder 24 as a web 32 of carded fibers. It is to be appreciated that the direction of rotation of the input cylinder 12 is arbitrary and can be in the direction opposite that shown in the various figures, the feed device being disposed to supply fiber stock to the input cylinder for carrying forward to the transfer region.

Figure 3:
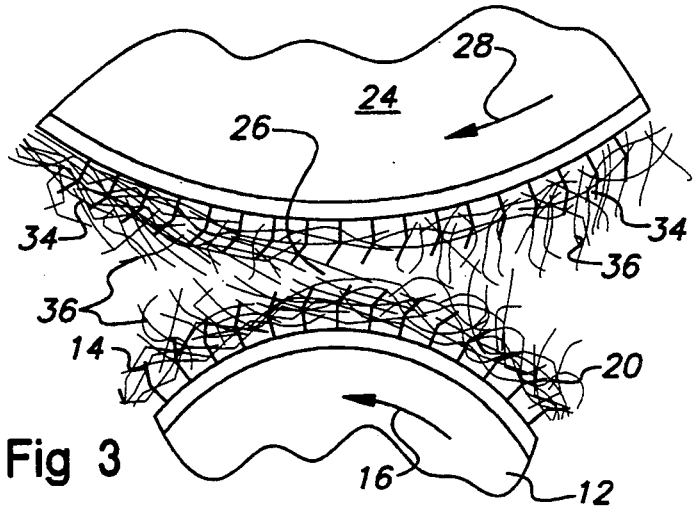
FIG. 3 illustrates a problem encountered when carding fine fibers.

Referring to FIG. 3, when fine-fiber hair is carded, e.g., angora rabbit and mohair, the shorter, smoother fibers tend to form a web 34 having a villous or fluffy nap 36. Individual fibers tend to be caught and pulled up but not extracted, thereby rapidly accumulating nap 36 above the wire clothing 14 of the input cylinder 12, while the extracted fibers likewise nap and build up fluff 36 on the carding cylinder 24. The napped fibers on the carding cylinder readily transfer back to the input cylinder 12, interfering with carding action, all of which results in an excessively fluffy batt 34 of partially and incompletely carded fibers.

Referring to FIGS. 1 and 4, a brush 40 suitably mounted to a frame (not shown) of the carding machine 10 on which the drums 12, 24 are mounted, includes bristles 42 gripped in a holder or brush back 44, the bristles extending into the wire clothing 30 of the carding cylinder 24. The brush 40, depicted from on end in FIGS. 1 and 4, is a stationary, elongate member which extends across the moving face of the carding cylinder 24 along a line parallel to the transfer region 26, ends of the brush being substantially aligned with the ends of the cylinder.

Referring to FIG. 4, ends 46 of the bristles 42 mesh with the card-cloth wires 30, and as the carding cylinder 24 rotates in the direction indicated by the arrow 28, the bristles continuously brush the napped fibers 36 down into the spaces between the wires 30, resulting in a web 48 of carded fibers having little if any nap or fluff. The nap 36 tends to be amorphous, i.e., extending in all directions, laterally and diagonally as well as normal to the axes of the cylinders 12, 28; therefore, the action of the brush 40 forces fibers into the clothing 30 in all directions and contributes to the uniform distribution of density of fibers in the web 48, thereby enhancing the normal carding process.

Although the action of the brush 40 can be characterized as combing the nap 36, it is understood that the brushing action according to the instant invention is distinct from "combing," the latter term, in one connotation, being a term of art relating to the processing of longer fibers in the production of worsted yarn, wherein shorter fibers are removed from a carded sliver of long-staple fibers, and the longer ones made more parallel to produce a top of worsted yarn. Therefore, when the term comb or combing is referred to herein in connection with the apparatus and method of the instant invention, the art connotation of the term is repudiated.

As the carding cylinder 24 rotates and the card-cloth wires 30 track through the bristles 42, the napped fibers 38 are forced down into the wires of the card clothing 30. The brushed web of fibers 48, having the nap 36 coalesced therein continues in rotation around the swift 24 until it again approaches the transfer region 26, where the card-cloth wires 30', being substantially free of nap, readily catch and extract napped fibers that may be protruding from the surface of the wire clothing 14 of the input cylinder 12. The brush 40 thus serves to reduce napped fibers on both the swift 24 and the input cylinder 12. Further, it is believed that the action of the brush 40 combing and forcing the napped fibers down into the card-cloth wires discharges static electricity from the fibers. The brush 40 is preferably located as close as practicable to the transfer region 26, the bristles 42 lying substantially on a radial plane of the carding cylinder 24. I have discovered that a brush mounted in a similar fashion as previously described to the carding cylinder at a location remote from the transfer region 26, for example at locations designated in FIG. I by reference character 49, while satisfactorily inhibiting the buildup of napped fibers on the carding machine, is less effective than a brush adjacent the transfer region.

The carding process is dependent upon the nature of the fiber stock input, and therefore the configuration of a particular carding machine can vary widely. While the schematic representation of the carding machine in FIGS. 1–4 is illustrated with a carding cylinder of greater diameter than the input cylinder, and the carding cylinder is described as operating at higher surface speed than the input cylinder, it is to be appreciated that other configurations can be employed. For example the carding cylinder can be a smaller, slower moving drum, which extracts fibers from a larger diameter, faster moving cylinder which carries forward (and therefore, is commonly termed a "carrying-forward" cylinder) uncarded fibers or a web of partially carded fibers from an upstream carding stage or a feed device of the carding machine.

Although the instant invention is of particular importance in the carding of fine-fiber hair, it is to be understood that such is merely illustrative, and many other kinds of fiber stock including both natural and nonnatural fibers and blends of fibers may be used in applying the invention. Examples of such other fibers are nylon, rayon, ramie and silk remnants.

Referring now to FIGS. 5–8, there is illustrated a cylinder carding machine 50 of a type commonly called a drum carder, which is utilized by artisans to prepare fiber stock for spinning. The drum carder 50 comprises a rectangular frame 51, suitably of hardwood, upon which are mounted the operating elements of the carder, including a carding drum or swift 52, an input drum or licker-in 53, a drive mechanism 54, a feed pan 55, and a fine-fiber brush assembly 56. The frame 51 is supported above a work surface by rubber-tipped legs 57.

The swift 52 is provided with card-cloth wire 58 covering substantially the entire curved cylindrical surface of the drum 52. A discontinuity 60 of the card-cloth wire 58, which extends across the face of the drum, is suitably covered with a metal strip 62, and is provided to facilitate removal or dolling of a web of carded fibers from the swift, as described below. The swift 52 is mounted for rotation on a centrally disposed shaft 64 journaled in bearings 66, which are press fit and bonded in bearing blocks 68. The position and parallelism of the swift 52 are adjustable by changing the longitudinal position of the bearing blocks 68, which are slidably attached to the frame 51 by bolts 70 extending through slotted apertures 72 defined in either end of the bearing blocks 68. The bolts 70 further extend through snug-fit bores 74 in the frame 51 and are fastened therein with suitable hardware such as washers and nuts. Adjustment devices 76 on either side of the frame 51 facilitate slidably positioning the bearing blocks 68 longitudinally on the frame 51, thereby changing the position and parallelism of the swift 52 with respect to the licker-in 53. Each of the adjustment devices 76 comprises an eyebolt 78 with its head 79 attached to the bearing block 68, the eyebolt having a stepped shaft 80 with a threaded end 82 secured to an angle bracket 84 by adjusting nuts 86, the angle bracket 84 being affixed to the frame 51.

A power source, suitably a hand crank 87 (FIG. 5) or a small electric motor (not shown) connected through a coupling 88 to the shaft 64, rotates the swift 52 in the direction indicated by arrow 90 and provides motive force for the drive mechanism 54 of the drum carder 50.

Figure 7:
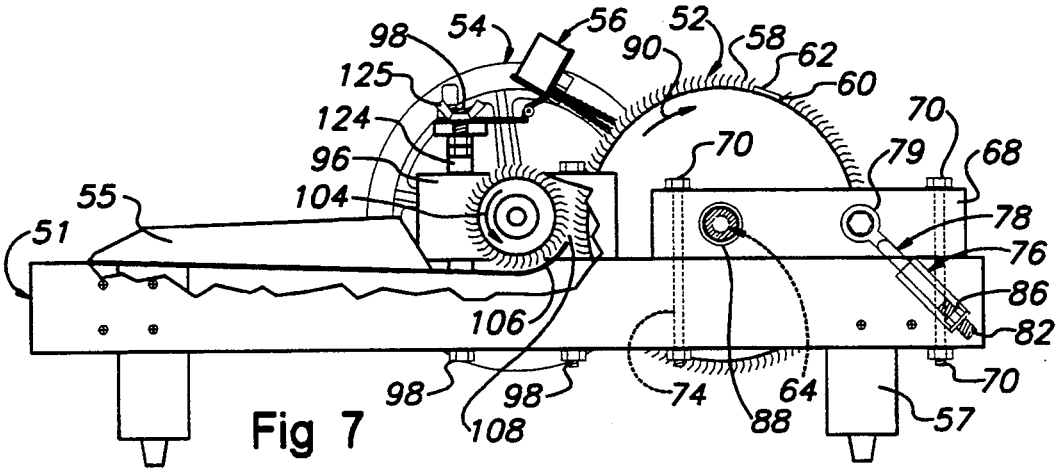
FIG. 7 is a front elevational view of the drum carder of FIG. 5.
Figure 8:
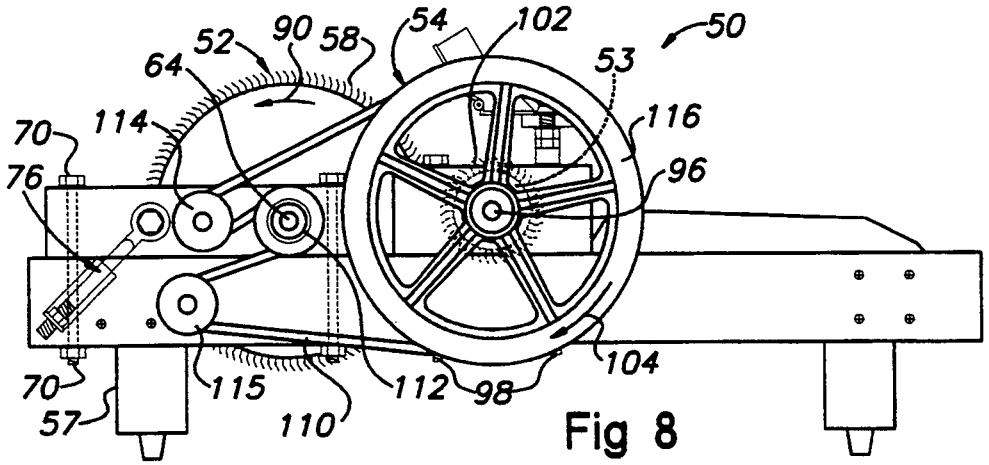
FIG. 8 is a rear elevational view of the drum carder of FIG. 5.

The input drum or licker-in 53 is mounted for rotation on a centrally disposed spindle 92 journaled in bearings 94, which are press fit and bonded in pillow blocks 96. The pillow blocks 96 are attached to the frame 51 by suitable fastening hardware 98 such as bolts, washers and nuts. The feed pan or chute 55 mounted to the frame 51 in front of and beneath the licker-in 53 receives fiber stock 100 such as wool spread thereon for feeding to the licker-in. Card-cloth wire 102 covers substantially the entire curved cylindrical surface of the licker-in 53, which rotates in a direction indicated by arrow 104 (FIG. 7). A curved portion 106 of the feed pan conforms to a radius defined by the locus of points of the wire clothing 102 and approaches closely but does not make contact with the wires. The proximity of the wire points with the interiorly disposed curved surface 108 of the feed pan 55 serves to regulate the amount of fiber caught and carried forward by the card-cloth wire 102 of the licker-in.

The licker-in 53 and the swift 52 are disposed in proximate tangential relation at a transfer region 108 constituted by a narrow space between the surfaces defined by the respective loci of points of the card-cloth wires 58, 102 of the drums, which approach closely but do not touch or intermesh. Proper width and parallelism of the space 108 is achieved, suitably with the aid of a feeler gauge, by turning the adjusting nuts 86 of the adjustment devices 76, which facilitate longitudinal translation of the bearing blocks 68 in which the centrally disposed shaft 84 of the swift is journaled.

The points of the card-cloth wire 58 of the swift 52 are pitched in the direction of rotation 90, and opposite the direction of pitch of the card-cloth wires 102 of the licker-in 53. Referring to FIGS. G and 8, the drive mechanism 54 operatively couples the two cylinders 52, 53 by means of a drive belt 110, which is powered by a drive pulley 112 affixed to the shaft 64 of the swift 52. The belt 110 tracks around reversing guide pulleys 114, 115 and powers a driven pulley 116, which is affixed to the spindle 96 of the licker-in, thereby rotating the licker-in 53 in the direction 104 opposite the direction of rotation 90 of the swift 52. The swift 52 rotates considerably faster than the licker-in 53, and although the direction of movement of the two card-cloth surfaces 58, 102 is the same at the transfer region 108, the sense of direction of movement of the two surfaces with respect to each other is opposite.

Figure 9:
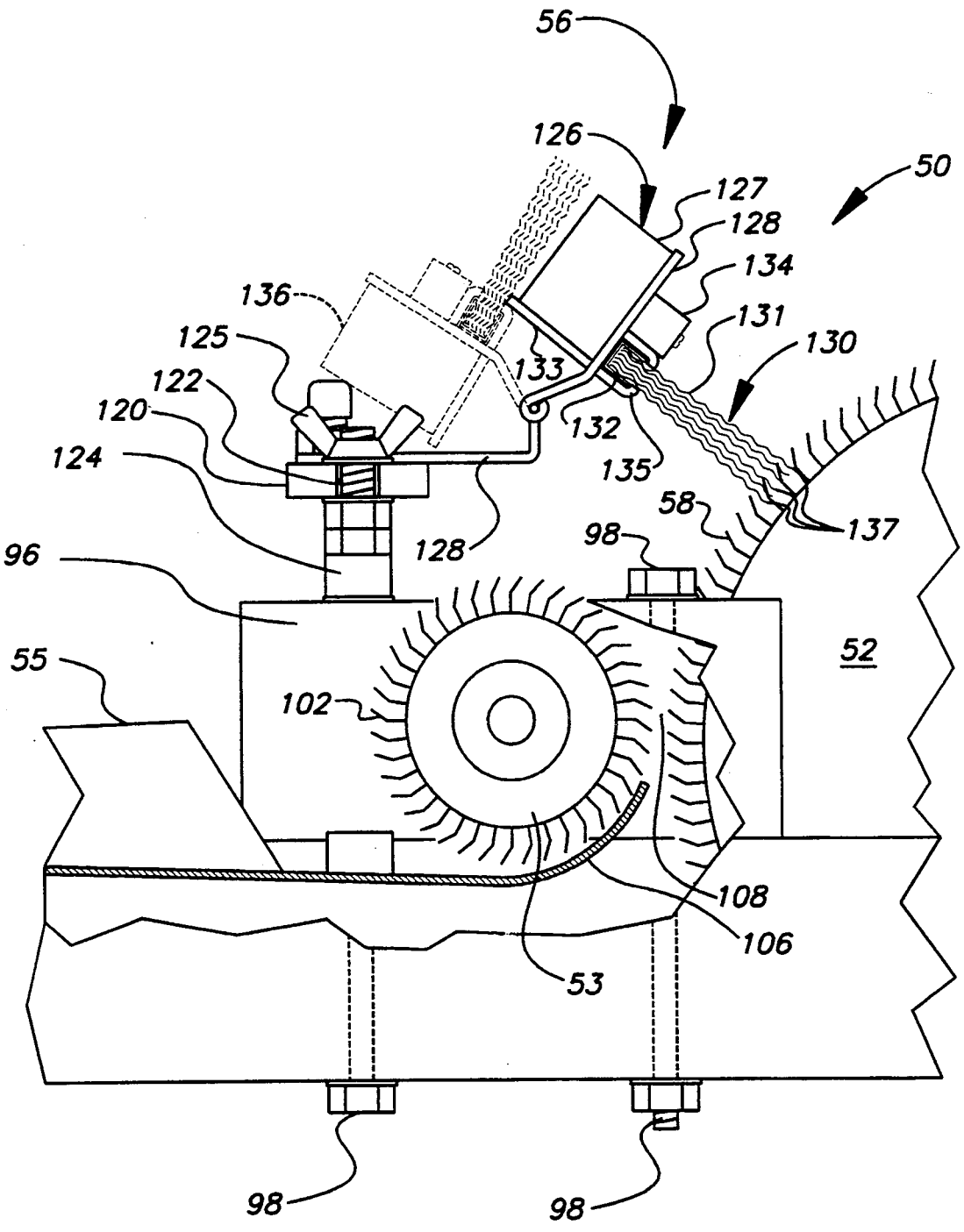
FIG. 9 is an enlarged view, partially cut away, of the drum carder of FIG. 5 showing the transfer region and the fine-fiber brush assembly according to the invention.

Referring to FIGS. 7 and 9, the fine-fiber brush assembly 56 is retractably mounted on the drum carder 50 to a fixed cross member 120, suitably made of hardwood and having end slots 122 which receive therein the shaft of the pillow block attachment bolts 98. Suitable spacers 124 installed between the pillow blocks 96 and the cross member 120 elevate the brush assembly 56 sufficiently above the input drum 53 to prevent interference with the card-cloth wires 102, and conventional fastening hardware includes washers, lock nuts and wing nuts 125. A movable portion 126 of the brush assembly 56 comprises a hardwood block 127 attached by outboard hinges 128 to the cross member 120, the block 127 providing a mounting member to affix a brush 130 in position for engagement with the card-cloth wire 58 of the swift 52. The brush 130, an elongate element cut from commercially available brush stock to a length which is substantially the breadth of the swift card clothing, comprises a plurality of crimped nylon bristles 131 set in a holder or brush back 132. The brush back 132 is held between two retaining members, a retainer plate 133 and a weight block 134, which are attached to the hardwood block 127 by suitable fasteners. The retainer plate, suitably of metal, includes a flanged edge 135 which engages and retains the brush back 132 on one side, while the other side of the brush back abuts the weight block 134. The hinged and weighted hardwood block 127 provides a convenient handle, which can be grasped for rotating the movable portion 126 of the brush assembly 56 from a retracted position illustrated by broken lines 136, to a working or engaged position as shown in FIG. 9. When moved to the retracted position 136, the movable portion 126 of the brush assembly is disposed in noninterfering relation with the swift 52, which facilitates dolling the swift. In the working position, the brush 130 is held with the bristles 131 extending outward from the block 127 toward the swift 52, distal ends 137 of the bristles 131 engaged in the card-cloth wires 58. The weight block 134, suitably a length of square steel stock, provides mass for holding the resilient bristles 131 of the relatively light weight brush 130 engaged in and stationary with respect to the rapidly moving card-cloth wires 58, which tend to urge the bristles up and away from the wires. The bristles 131, in the engaged position, are suitably oriented on a radial plane of the carding drum 52.

Carding takes place, similarly as described above with reference to FIGS. 1–4, when the card-cloth wires of the licker-in 53 carry forward the fiber stock 100 from the feed pan 55 to the transfer region 108, where fibers projecting above the card-cloth wire 53 of the licker-in 53 are caught by the rapidly moving wire clothing 58 of the swift 52, pulling fibers away against resistance from the smaller licker-in 53, thus disentangling and opening the mat of fibers, the extracted fibers then coalescing on the wired surface of the swift 52 as a web of carded fibers. Napped fibers protruding above the surface of the swift are forced down into the wires 58 by bristles 131 of the brush 130, the ends 137 of which engage and comb through the moving wires 58, the brush 130 rising up as the bart of carded fibers forms and becomes thicker. When a web of sufficient thickness accumulates on the swift, the process is completed by stopping the carder drive mechanism 54, hinging the movable portion 126 of the brush assembly 56 away from the swift 52 to the retracted position 136, and dolling or manually removing the batt of carded fiber from the machine by passing a thin rod under the batt and across the swift at the location of the metal strip 62. By lifting the rod and carefully parting the web, the batt of carded fibers can then be pulled away from the surface of the cylinder.

In an industrial carding machine, carded fibers are stripped from the carding cylinder (termed a worker) by a more rapidly revolving stripper drum having card-cloth wires operating point against back in relation to the wires of the worker; and a web of carded fiber is doffed from the swift by a slowly revolving dolling cylinder having card-cloth wires operating point against point in relation to the wires of the swift, the dolling cylinder collecting the web raised above the card-cloth surface of the swift by an Upstream fancy roller.

In one example of a drum carder according to the invention, the hardwood frame 51 has a length of 56 centimeters (22 inches) and a width of 30.5 cm (12 in.). The swift 52 is 20.3 cm. (8 in.) wide and 17.8 cm. (7 in.) in diameter, exclusive of the height of the card-cloth wires 58. The swift yields a web of carded fibers about 20.3 cm. 8 in.) wide and 61 cm. (24 in.) long. The licker-in 53 is 5 cm. (2 in.) in diameter and 20.3 cm. (8 in.) wide. The wire clothing of both cylinders is typically medium fine and sharp: No. 34 (American Gauge) 0.254 millimeter (0.010 in.) round wire, 4 twill set and common pitch, which clothing has proven satisfactory for a wide variety of fleeces and fibers; and with the addition of the brush assembly 56 in accordance with the present invention, the range of fibers that can be satisfactorily processed with this configuration of clothing is considerably expanded. The brush 130 comprises bristles 131 of crimped nylon 4.5 cm. (1.75 in.) long and 0.28 mm. (0.011 in.) thick, the gathered bristles set in the brush back 132 at their proximal ends having a thickness of about 4.8 mm. (3/16 in.) and flaring at the distal ends 137 to about 12.7 mm. (½ in.). The weight block 134 suitably weighs 215 grams (7.6 ounces).

The cylinders 52, 53 being linked mechanically, the speed of rotation of a drum carder, whether operated by a hand crank or other motive power, has only minimal effect on the carding process, i.e., regardless how fast or slow the carder is cranked, the ratio of surface speeds of the cylinders remains constant. The speed of operation of a drum carder is limited largely by the rate at which the stock can be fed into the licker-in, and is suitably about fifty revolutions per minute of the swift in the presently described embodiment of a drum carder according to the invention. However, in drum carders driven by a small electric motor, speeds of 90 RPM or greater are practical, without outstripping the ability of most operators to feed fiber stock effectively into the machine.

It is the ratio of the surface speeds of the two cylinders which determines, to a large extent, the nature of the carding effected: the greater the difference in the relative surface speeds, the slower the transfer of fibers from the input cylinder to the carding cylinder. For example, uncarded fiber stock processed on a drum carder, while conventionally a well opened and picked stock, generally comprises a fairly dense and random compaction of fibers, and therefore a rapid transfer of the fibers with minimum carding is desirable to preclude damage to the fibers or jamming of the machine. Other, finer fiber stock, which can be in the form of a partially carded web or lap of fibers, requires a slower rate of fiber transfer, i.e., the stock should be held relatively longer on the licker-in and subjected to the carding action of the swift for an equally longer period. In the processing of fine fiber stock on a drum carder in accordance with the presently described embodiment of the invention, the ratio of surface speed of the swift 52 to the licker-in 53 is suitably about 25:1. The ratio of surface speeds is easily and conveniently changed by altering the drive mechanism 54, e.g., the ratio is increased by decreasing the diameter of the drive pulley 112 or increasing the diameter of the driven pulley 116.

Tests on a variety of cylinder carding machine configurations, processing a broad range of fiber stock, have demonstrated that the batts of carded fiber produced using the fine-fiber brush according to my invention are equal to or better than those produced on a machine without a brush, but having finer card clothing. The tests also show that the fine-fiber brush produces improved batts of carded fiber equally well with machines having a range of card-cloth densities from extremely coarse to very fine.

While the principles of my invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. For example, while the fine-fiber brush is described above as being retractably mounted to the-frame of a carding machine, the brush can be affixed to the frame with the bristles engaged in the card-cloth wire. The appended claims are, therefore, intended to cover and embrace any such modifications, within the limits only of the true spirit and scope of the invention.

I claim:

1. A cylinder carding machine, comprising:

a frame, a first carding cylinder rotatably mounted on the frame, a second carding cylinder rotatably mounted on the frame adjacent the first carding cylinder to define therebetween a transfer region, drive means for rotating the first and second carding cylinders, means for feeding fiber stock to the carding machine, the first carding cylinder including means for carrying forward the fiber stock to the transfer region, the second carding cylinder including means coacting with the carrying forward means at the transfer region for carding the fiber stock, a batt of carded fibers accumulating on the second carding cylinder, and stationary means mounted on the frame for inhibiting, during operation of the carding means as the batt of carded fibers accumulates, accumulation of the fibers on the outer portion of the second cylinder by forcing the fibers protruding from the batt of carded fibers onto the second carding cylinder.

2. The cylinder carding machine according to claim 1 wherein the carding means comprises card-cloth wires and the means for inhibiting the accumulation of the fibers comprises a stationary brush having bristles engaged in the moving card-cloth wires of the second carding cylinder.

3. The cylinder carding machine according to claim 1 wherein the carding means comprises card-cloth wires and the means for inhibiting the accumulation of the fibers comprises a retractable brush having bristles with ends engageable in the moving card-cloth wires of the second carding cylinder.

4. The cylinder carding machine according to claim 3 further comprising means for holding the bristles of the retractable brush engaged in the moving card-cloth wires of the second carding cylinder.

5. The cylinder carding machine according to claim 4 wherein the holding means comprises a weight affixed to the retractable brush, the weight countering a force of the moving card-cloth wires of the carding means, which force tends to urge the bristles to disengage from the moving card-cloth wires.

6. In a process of carding fiber on a cylinder carding machine having a carrying-forward cylinder and a carding cylinder tangentially adjacent to each other, each of the cylinders having card-cloth wires pitched point against point with respect to the card-cloth wires of the other cylinder, and a brush member mounted on the carding machine, the process comprising the steps of:

rotating the cylinders so that the respective card-cloth wires of the carrying-forward cylinder and the carding cylinder pass in opposite sense of direction, charging the card-cloth wires of the carrying-forward cylinder with fiber stock, and as the cylinders rotate and fibers transfer from the carrying-forward cylinder to the carding cylinder to form a web of carded fibers on the carding cylinder, brushing down napped fibers protruding from the web of carded fibers on the carding cylinder into the card-cloth wires of the carding cylinder, and stripping the web of carded fibers from the carding cylinder.

7. In a process of carding fiber with a drum carder having licker-in and swift drums, each with card-cloth wire disposed on a cylindrical surface thereof, the card-cloth wire of each drum disposed point against point with respect to the card-cloth wire of the other, the process including the steps of rotating the drums so that the card-cloth wire of the respective drums moves in opposite sense of direction, charging the card-cloth wire of the licker-in with fiber stock while the drums are rotating, and after the drums have rotated a sufficient time to transfer fibers from the licker-in to the swift to form on the swift a batt of carded fibers, stopping the drum rotation, and doffing the batt of carded fibers from the swift, the improvement comprising the additional steps of affixing a brush member to the drum carder, and brushing down napped fibers protruding from the batt of carded fibers into the card-cloth wire of the swift while the drums are rotating and as the batt of carded fibers forms.

8. The improved carding process according to claim 7 wherein the brushing step includes, prior to the rotating step, engaging bristles of a retractable brush with the card-cloth wire of the swift.

9. The improved carding process according to claim 8 wherein the brushing step includes, prior to the doffing step, retracting the brush from engagement with the card-cloth wire of the swift to a retracted position in noninterfering relation with the swift.

10. In a cylinder carding machine having a frame, an input cylinder and a carding cylinder, both cylinders mounted for rotation on the frame, each of the cylinders having card-cloth wires disposed point against point with respect to the card-cloth wires of the other cylinder, the cylinders tangentially adjacent each to the other at a transfer region defined by a gap between respective card-cloth surfaces of the cylinders, a drive mechanism rotating the cylinders so that the respective card-cloth surfaces move in opposite sense of direction, a feed device supplying fiber stock to the input cylinder while both cylinders rotate, the input cylinder carrying the fiber stock forward to the transfer region, the carding cylinder extracting fibers from the fiber stock at the transfer region to form a batt of carded fibers on the carding cylinder, the improvement comprising: a brush mounted on the frame, the brush having substantially stationary bristles engaged in the moving card-cloth wires of the carding cylinder, whereby napped fibers protruding from the batt of carded fibers on the carding cylinder are brushed down into the card-cloth wires.

11. The carding machine according to claim 10 wherein the improvement further comprises a brush mount having a fixed portion attached to the frame and a retractable portion attached to the fixed portion, the brush being affixed to the retractable portion and movable from a retracted position in noninterfering relation with the carding cylinder to a working position in which the bristles engage the card-cloth wires of the carding cylinder.

12. The carding machine according to claim 11 wherein the improvement further comprises a weight affixed to the retractable portion of the brush mount, the weight holding the bristles substantially stationary with respect to the moving card-cloth wires of the carding cylinder when the retractable portion of the brush mount is moved to the working position.

13. A cylinder carding machine, comprising:

a frame;

an input cylinder mounted for rotation on the frame, the input cylinder having a curved peripheral surface substantially covered with card-cloth wire;

a carding cylinder mounted for rotation on the frame, the carding cylinder having a curved peripheral surface substantially covered with card-cloth wire, the card-cloth wire of each of the cylinders being pitched point against point with respect to the card-cloth wire of the other cylinder, the cylinders tangentially adjacent each to the other at a transfer region defined by a gap between respective card-cloth surfaces of the cylinders;

a drive mechanism rotating the cylinders, the respective card-cloth surfaces of the cylinders moving in opposite sense of direction;

a feed device supplying fiber stock to the input cylinder while both cylinders rotate, the input cylinder carrying the fiber stock forward to the transfer region, the carding cylinder extracting fibers from the fiber stock at the transfer region to form a batt of carded fibers on the carding cylinder, and a brush mounted on the frame, the brush having bristles engageable in the moving card-cloth wire of the carding cylinder, the bristles when engaged being substantially stationary with respect to the moving card-cloth wires of the carding cylinder, whereby napped fibers protruding from the batt of carded fibers on the carding cylinder are brushed down into the card-cloth wire as the batt of carded fibers forms on the carding cylinder.

14. The cylinder carding machine according to claim 13, further comprising a mounting member having a fixed element attached to the frame, and a movable element attached to the fixed element, the brush being attached to the movable element of the mounting member, the movable element being movable from a retracted position in noninterfering relation with the carding cylinder to a working position in which the stationary bristles engage the moving card-cloth wire of the carding cylinder.

15. The cylinder carding machine according to claim 14, further comprising a weight affixed to the movable element of the mounting member, the weight holding the bristles engaged with the moving card-cloth wires of the carding cylinder when the movable element of the mounting member is in the working position.

16. An attachment to a cylinder carding machine, the carding machine having a frame, first cylinder means rotatably mounted on the frame for carrying forward fiber stock input to the machine, second cylinder means rotatably mounted on the frame adjacent the first cylinder means to define therebetween a transfer region, and drive means for rotating the first and second cylinder means, the first and second cylinder means including means coacting at the transfer region for carding the fiber stock carried forward by the first cylinder means to form a batt of carded fibers on the second cylinder means, the attachment comprising: a brush member, means for mounting the brush member in a stationary position on the frame, the stationary brush member being engageable in the moving carding means, the brush member when engaged inhibiting a buildup of napped fibers on the carding means by brushing down the napped fibers protruding from the batt of carded fibers on the second cylinder means as the batt of carded fibers forms on the second cylinder means.

17. The carding machine attachment according to claim 16 wherein the carding means comprises card-cloth wires and the brush member comprises a fixed brush having bristles engaged in the moving card-cloth wires.

18. The carding machine attachment according to claim 16 wherein the carding means comprises card-cloth wires and the brush member comprises a retractable brush having bristles with ends engageable in the moving card-cloth wires.

19. The carding machine attachment according to claim 18 further comprising means for holding the bristles of the retractable brush engaged in the moving card-cloth wires of the carding means.

20. The carding machine attachment according to claim 18 further comprising a weight affixed to the retractable brush, the weight countering a force of the moving card-cloth wires of the carding means, which force urges the bristles to disengage from the moving card-cloth wires.

21. The cylinder carding machine according to claim 2 wherein the bristles of the stationary brush engage the moving card-cloth wires of the second carding cylinder adjacent to and downstream of the transfer region.

22. In the cylinder carding machine according to claim 10, the improvement further comprising the bristles of the brush engaging the moving card-cloth wires of the carding cylinder adjacent to and downstream of the transfer region.

23. In the cylinder carding machine according to claim 11, the improvement further comprising the bristles of the brush when in the working position engaging the moving card-cloth wires of the carding cylinder adjacent to and downstream of the transfer region.

* * * * *

UNITED STATES PATENT AND TRADEMARK OFFICE

CERTIFICATE OF CORRECTION

PATENT NO. : 5,333,357
DATED : August 2, 1994
INVENTOR(S) : Richard N. Duncan

It is certified that error appears in the above-indentified patent and that said Letters Patent is hereby corrected as shown below:

IN THE DRAWING: Sheet 4 of 5, in the upper right-hand portion of the page beneath the patent number, delete the freehand written notation "4 of 5".

Column 1, lines 54, 56, and 64, change "bart" to --batt--. Column 2, line 19, change "dolling" to --doffing--. Column 3, line 18, change "bart" to --batt--; line 22, change "sheep," to --sheep.--; line 43, change "dolling" to --doffing--. Column 4, line 32, change "bart" to --batt--. Column 5, line 7, change "dolling" to --doffing--. Column 8, line 14, change "dolling" to --doffing--. Column 9, line 6, change "FIGS. G" to --FIGS. 6--; line 54, change "dolling" to --doffing--. Column 10, line 12, change "bart" to --batt--; lines 18, 29, and 32, change "dolling" to --doffing--; line 33, change "Upstream" to --upstream--.

Signed and Sealed this

Nineteenth Day of September, 1995

*Attest:*

Bruce Lehman

BRUCE LEHMAN

*Attesting Officer*

*Commissioner of Patents and Trademarks*